US011111849B1

(12) United States Patent
Poirier et al.

(10) Patent No.: US 11,111,849 B1
(45) Date of Patent: Sep. 7, 2021

(54) MARINE PROPULSION DEVICE AND LOWER UNIT THEREFOR

(71) Applicant: Brunswick Corporation, Mettawa, IL (US)

(72) Inventors: Randall J. Poirier, Fond du Lac, WI (US); John O. Scherer, III, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 10 days.

(21) Appl. No.: 16/720,675

(22) Filed: Dec. 19, 2019

(51) Int. Cl.

| | |
|---|---|
| ***B63H 5/10*** | (2006.01) |
| ***F02B 61/04*** | (2006.01) |
| *B63H 20/34* | (2006.01) |
| *B63H 23/32* | (2006.01) |
| *B63H 1/18* | (2006.01) |
| *B63H 20/28* | (2006.01) |

(52) U.S. Cl.
CPC ..... *F02B 61/045* (2013.01); *B63H 5/10* (2013.01); *B63H 20/285* (2013.01); *B63H 20/34* (2013.01); *B63H 23/321* (2013.01); *B63H 2001/185* (2013.01); *B63H 2023/323* (2013.01)

(58) Field of Classification Search
CPC ..... B63H 5/10; B63H 20/285; B63H 20/34; B63H 23/321; B63H 2023/323; B63H 2001/185; F02B 61/045
See application file for complete search history.

(56) References Cited

U.S. PATENT DOCUMENTS

| | | | |
|---|---|---|---|
| 2,847,967 | A | 8/1958 | Kiekhaefer |
| 3,799,103 | A | 3/1974 | Granholm |
| 4,122,792 | A | 10/1978 | Rhoades et al. |
| 4,304,557 | A | 12/1981 | Henrich |

(Continued)

FOREIGN PATENT DOCUMENTS

| | | | |
|---|---|---|---|
| CA | 1224382 | A | 7/1987 |
| DE | 202005001130 | U1 | 3/2005 |

(Continued)

OTHER PUBLICATIONS

Alby et al., "Outboard Motors Having Steerable Lower Gearcase," Unpublished U.S. Appl. No. 16/171,490, filed Oct. 26, 2018.

(Continued)

*Primary Examiner* — Stephen P Avila
(74) *Attorney, Agent, or Firm* — Andrus Intellectual Property Law, LLP

(57) ABSTRACT

A lower unit for a marine propulsion device includes a gearcase housing defined along a longitudinal center axis between a fore end and an aft end. A propulsor shaft extends through the gearcase housing along the longitudinal axis. A driveshaft extends non-parallel to the propulsor shaft and rotates in a direction of rotation when powered by an engine. The driveshaft is coupled in torque-transmitting relationship with the propulsor shaft. A skeg projects from a bottom surface of the gearcase housing proximate at least the aft end thereof. The skeg or the gearcase housing is cambered such that a moment acting in a direction opposite the driveshaft's direction of rotation is induced on the skeg or the gearcase housing as the lower unit moves through water. A marine propulsion device is also disclosed.

20 Claims, 7 Drawing Sheets

(56) References Cited

U.S. PATENT DOCUMENTS

| | | | | |
|---|---|---|---|---|
| 4,352,666 | A | 10/1982 | McGowan | |
| 4,529,387 | A | 7/1985 | Brandt | |
| 4,810,218 | A | 3/1989 | Iwai | |
| 5,085,603 | A * | 2/1992 | Haluzak | B63H 20/34 440/51 |
| 5,344,349 | A | 9/1994 | Meisenburg et al. | |
| 5,772,481 | A | 6/1998 | Alexander, Jr. et al. | |
| 6,558,213 | B1 | 5/2003 | McGowan | |
| 7,393,256 | B2 | 7/2008 | Clutton et al. | |
| 8,545,280 | B1 | 10/2013 | Patil et al. | |
| 8,821,205 | B2 | 9/2014 | Mead | |
| 9,359,059 | B1 | 6/2016 | Scherer et al. | |
| 9,738,362 | B2 | 8/2017 | Ketterman et al. | |
| 2006/0216007 | A1 | 9/2006 | Moreb | |
| 2008/0207070 | A1 | 8/2008 | Van Gelder | |
| 2010/0000461 | A1 | 1/2010 | Wait et al. | |
| 2018/0009516 | A1* | 1/2018 | Woody | B63H 20/106 |
| 2018/0265174 | A1 | 9/2018 | Miller | |

FOREIGN PATENT DOCUMENTS

| | | | |
|---|---|---|---|
| EP | 431678 | A1 | 6/1991 |
| JP | H05345593 | A | 12/1993 |
| JP | 2904789 | B2 | 6/1999 |

OTHER PUBLICATIONS

Scherer, John, "Marine Propulsion Device and Lower Unit Therefor," Unpublished U.S. Appl. No. 16/707,039, filed Dec. 9, 2019.

* cited by examiner

MARINE PROPULSION DEVICE AND LOWER UNIT THEREFOR

FIELD

The present disclosure relates to marine propulsion devices for propelling watercraft through water, and more specifically to lower units for marine propulsion devices.

BACKGROUND

The following U.S. patents and patent applications are incorporated herein by reference, in their entireties:

U.S. Pat. No. 5,085,603 discloses a marine drive having a trim tab with a flair on one side thereof at an upper portion. When the drive is trimmed in, the flair is unshrouded by the anti-ventilation plate and diverts mainstream water flow therearound, which produces a force on the other side of the trim tab opposite the flair which conteracts steering torque. In another embodiment, a variable compensation flair is provided.

U.S. Pat. No. 5,344,349 discloses a marine drive having two counter-rotating surface operating propellers. The upper end of the leading edge of the skeg is spaced forwardly of the lower end of the trailing edge of the skeg by a horizontal distance greater than the horizontal length of the torpedo, for full rudder control. The skeg has a first zone with outer surface profiles which are continuous and define continuous skeg sidewalls therealong. The skeg has a second zone above the first zone and with outer surface profiles along horizontal cross-sections, which profiles are discontinuous and define skeg sidewalls with openings therein. The horizontal cross-sections along the second zone have discontinuous gaps therein defining a cored passage within the skeg communicating with the openings in the sidewalls. The skeg has a third zone above the second zone and with outer surface profiles along horizontal cross-sections, which outer surface profiles define continuous skeg sidewalls along the third zone. The horizontal cross-sections along the third zone have gaps therein defining the continuation of the cored passage upwardly within the skeg and communicating with the torpedo portion.

U.S. Pat. No. 5,772,481 discloses a skeg assembly for a marine propulsion unit including a generally U-shaped saddle that is removably attached to the lower torpedo section of the gearcase of the propulsion unit, and a thin wedge-shaped skeg extends downwardly from the saddle. During planning conditions of the boat, the water line is slightly below the lower torpedo section so that the saddle is out of the water. The side surfaces of the skeg having opposed water intake openings each of which is bordered rearwardly by a laterally projecting shoulder that terminates in a sharp vertical edge and the intake openings are bordered forwardly by a curved surface that connects the side surfaces of the skeg. The water intake openings communicate with a water passage in the skeg which, in turn, communicates with a water passage in the torpedo section so that water can be delivered to the cooling system of the propulsion unit.

U.S. Pat. No. 8,545,280 discloses a marine drive having a lower drive unit including a gearcase with a vertical strut having a lower horizontal torpedo with an aft propeller. An anti-ventilation plate on the strut is spaced above the torpedo. A spray shield plate on the strut is spaced above the torpedo and below the anti-ventilation plate.

U.S. Pat. No. 9,359,059 discloses an outboard marine engine comprising an anti-ventilation plate; a torpedo housing that is disposed below the anti-ventilation plate; and a gearcase strut that extends from the anti-ventilation plate to the torpedo housing. The gearcase strut has a leading end, a trailing end, and opposing outer surfaces that extend from the leading end to the trailing end. A flow separator is on each outer surface. The flow separator is located closer to the trailing end than the leading end and causes flow of water across the gearcase strut to separate from the outer surface.

U.S. application Ser. No. 16/171,490, filed Oct. 26, 2018, discloses an outboard motor having a powerhead that causes rotation of a driveshaft, a steering housing located below the powerhead, wherein the driveshaft extends from the powerhead into the steering housing; and a lower gearcase located below the steering housing and supporting a propeller shaft that is coupled to the driveshaft so that rotation of the driveshaft causes rotation of the propeller shaft. The lower gearcase is steerable about a steering axis with respect to the steering housing and powerhead.

SUMMARY

In one embodiment, a lower unit for a marine propulsion device is disclosed. The lower unit comprises a gearcase housing defined along a longitudinal center axis between a fore end and an aft end. A propulsor shaft extends through the gearcase housing along the longitudinal axis. A driveshaft extends non-parallel to the propulsor shaft. The driveshaft is configured to rotate in a direction of rotation when powered by an engine of the marine propulsion device. The driveshaft is coupled in torque-transmitting relationship with the propulsor shaft. A skeg projects from a bottom surface of the gearcase housing proximate at least the aft end thereof. One of the skeg and the gearcase housing is cambered such that a moment acting in a direction opposite the driveshaft's direction of rotation is induced on the one of the skeg and the gearcase housing as the lower unit moves through water.

In another embodiment, a marine propulsion device is disclosed. The marine propulsion device includes an engine and a driveshaft configured to be powered by the engine and thereby to rotate in a direction of rotation. A propulsor shaft is coupled in torque-transmitting relationship with the driveshaft. A propulsor is coupled to the propulsor shaft and rotatable to produce a thrust. A housing supports the propulsor shaft therein. The housing has a skeg projecting from a bottom surface thereof. One of the skeg and the housing is cambered such that a moment acting in a direction opposite the driveshaft's direction of rotation is induced on the one of the skeg and the housing as the housing moves through water.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
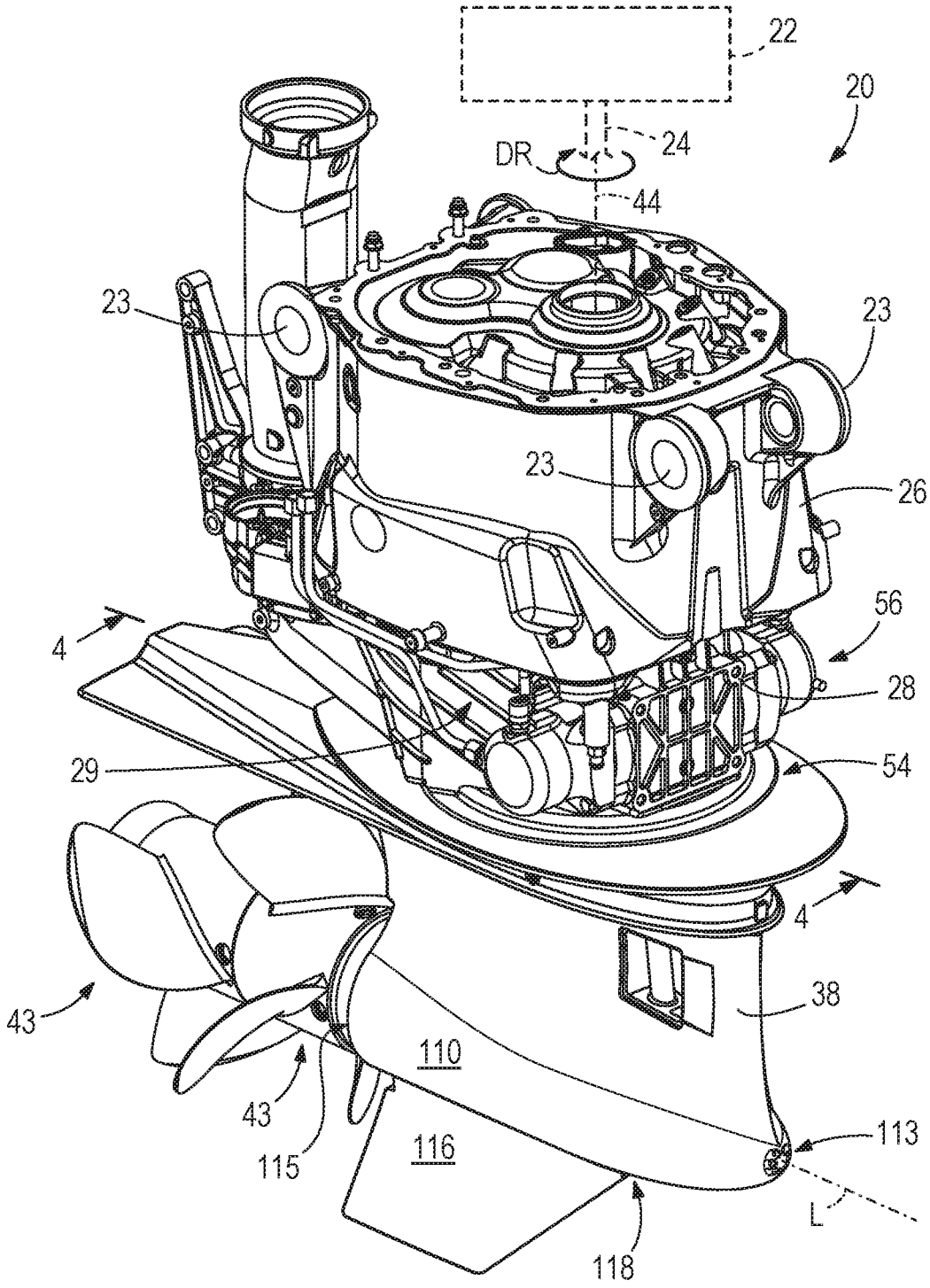
FIG. 1 is a perspective view of a driveshaft housing, steering housing, and lower unit of a marine propulsion device according to an embodiment of the present disclosure.

FIG. 1 depicts a first embodiment of a marine propulsion device (here, an outboard motor) 20 powered by an internal combustion engine (shown schematically at 22 in FIG. 1), for causing rotation of an axially extending driveshaft 24. The driveshaft 24 extends into a driveshaft housing 26 located below the engine 22. Optionally, the driveshaft housing 26 contains a sump for containing oil or similar lubricant for the engine 22. Optionally, the driveshaft 24 is connected to a transmission for engaging forward, reverse, and neutral gear positions of the marine propulsion device 20. Optionally, the driveshaft housing 26 also includes mounting locations 23 for mounting the marine propulsion device 20 to a supporting cradle that is coupled to a transom bracket and/or the like, for supporting the marine propulsion device 20 with respect to the transom of a marine vessel. The type and configuration of the driveshaft housing 26 is merely exemplary and can vary from what is shown.

Figure 2:
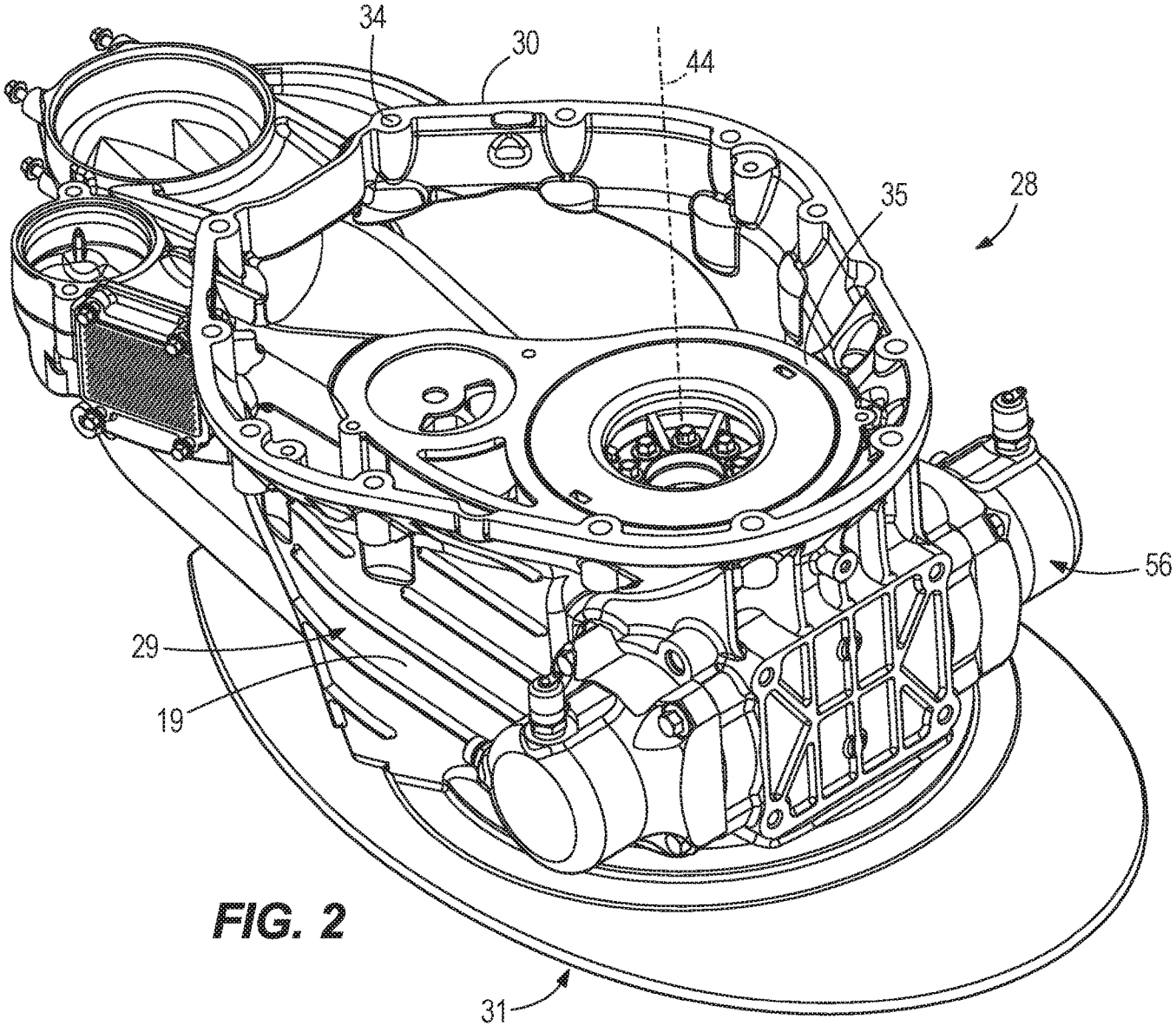
FIG. 2 is a perspective view looking down at a steering housing of the marine propulsion device.

Referring to FIGS. 1 and 2, a steering housing 28 is located below the driveshaft housing 26. The steering housing 28 is a generally oblong member having a main body 29 and upper and lower perimeter mounting flanges 30, 31. The upper perimeter mounting flange 30 is fixed to the lower perimeter of the driveshaft housing 26 by bolts (not shown) engaged in bolt holes 34. The bolts and bolt holes 34 are spaced apart around the upper perimeter mounting flange 30, as shown, so that the steering housing 28 and driveshaft housing 26 remain securely fixed together. A center column 35 defining a through-bore 36 (see FIG. 3) axially extends from top to bottom through the steering housing 28. The driveshaft 24, itself or via an extension member, axially extends through the through-bore 36. In the illustrated example, the center column 35 and through-bore 36 are generally cylindrical and contain a bearing arrangement for supporting steering of the marine propulsion device 20, as will be further described herein below.

Figure 4:
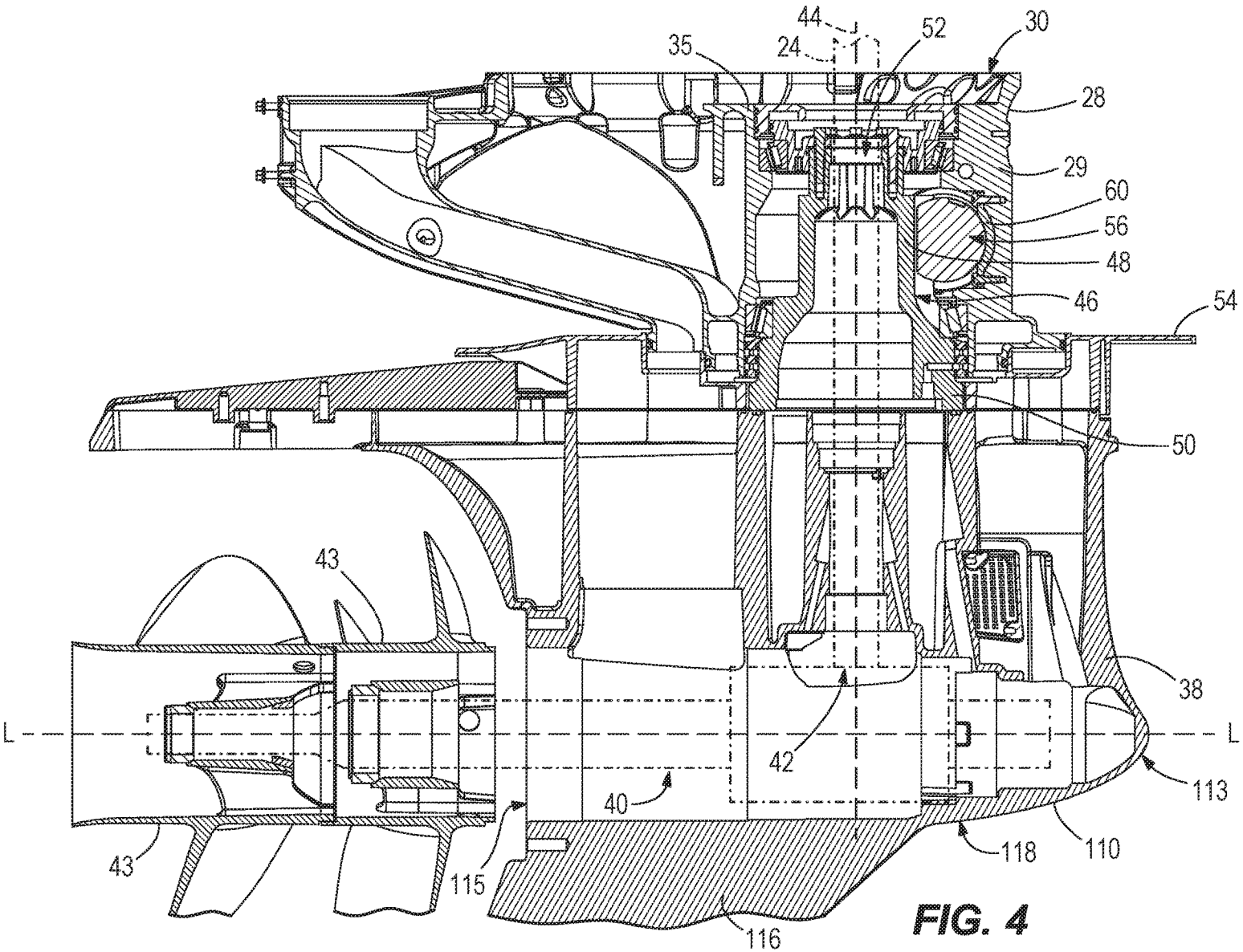
FIG. 4 is a view of section 4-4, taken in FIG. 1, showing the lower unit and steering housing of the marine propulsion device.

Referring to FIGS. 1 and 4, the marine propulsion device 20 also has a lower unit 38, which is located below the steering housing 28 and includes a gearcase housing 110 defined along a longitudinal center axis L between a fore end 113 and an aft end 115. The gearcase housing 110 supports a propulsor shaft extending through the gearcase housing 110 along the longitudinal axis L. In this example, the gearcase housing 110 supports two longitudinally extending propeller shafts, the location of which is shown via dashed lines 40 in FIG. 4. Although the illustrated example utilizes a pair of counter-rotating propeller shafts 40, an arrangement with only one propeller shaft could instead be employed. The driveshaft 24 or an extension thereof extends into the gearcase housing 110 non-parallel (here, perpendicular or near perpendicular) to the propulsor shaft (e.g., propeller shafts 40). The driveshaft 24 is configured to rotate in a direction of rotation DR when powered by the engine 22 and is coupled in torque-transmitting relationship with the propulsor shaft, for example directly thereto or via an axial extension thereof (which is therefore also a driveshaft), by a conventional angled gearset, the location of which is shown by dashed lines 42. The angled gearset 42 is configured in the usual way so that rotation of the driveshaft 24 about its own axis causes counter-rotation of the propeller shafts 40 about their own longitudinally extending axes. Counter-rotating propellers 43 are mounted on the pair of propeller shafts 40, respectively, so that rotation of the propeller shafts 40 causes rotation of the propellers 43. Rotation of the propellers 43 generates thrust forces in water, all as conventional. A skeg 116 projects from a bottom surface 118 of the gearcase housing 110 proximate at least the aft end 115 thereof.

Figure 3:
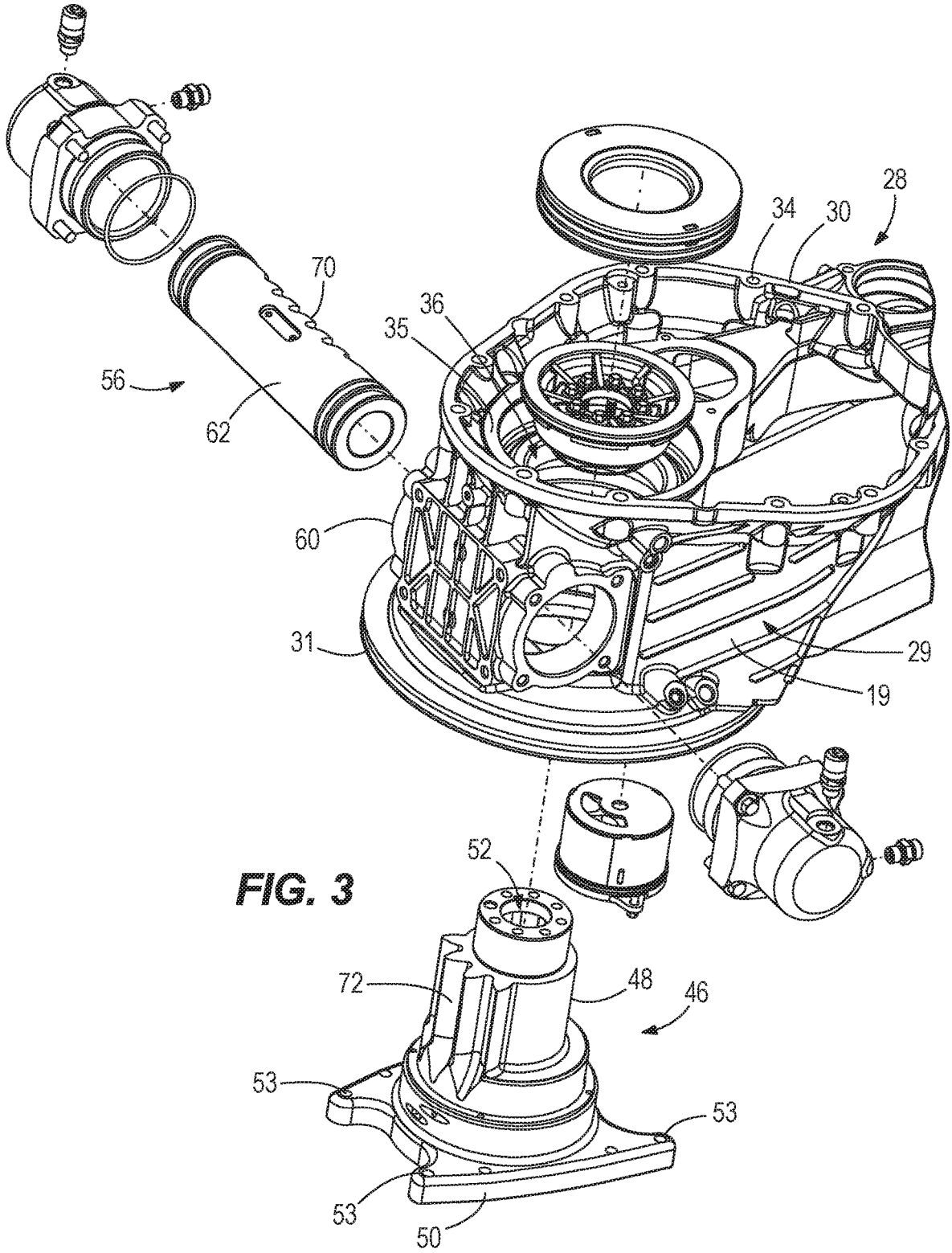
FIG. 3 is an exploded view showing the steering housing, steering actuator, and a steering column of the marine propulsion device.

Referring to FIGS. 1 and 3, the lower unit 38 is steerable about a steering axis 44 with respect to the steering housing 28 and engine 22, and thus is steerable to change a direction of thrust produced by the marine propulsion device 20. In the illustrated example, the steering axis 44 is coaxial with the driveshaft 24. A steering column 46 (FIG. 3) is fixed to the top of the lower unit 38 and extends upwardly into the bottom of the steering housing 28. The steering column 46 is an elongated member having a center column 48 that extends upwardly from a lower perimeter mounting flange 50. A through-bore 52 extends through the center column 48 and defines an open interior in the center column 48. The driveshaft 24 (or the extension thereof) extends through the open interior of the center column 48, into the lower unit 38, and into engagement with the noted propeller shafts 40 via the noted angled gearset 42.

Referring to FIGS. 1 and 4, a cover 54 is fixed to the top of the lower unit 38. Optionally, the cover 54 is a plate member that is separate component from the lower unit 38. The lower perimeter mounting flange 50 of the steering column 46 is coupled to the cover 54 via bolts (not shown). The bolts extend through bolt-holes 53 (FIG. 3) formed through the lower perimeter mounting flange 50 on the steering column 46 and through the cover 54, respectively, and fix the cover 54 with respect to the lower unit 38 so that the lower unit 38, cover 54 and steering column 46 rotate together with respect to the steering housing 28. The manner in which the steering column 46 is fixed to the top of the lower unit 38 can vary from what is shown and described.

Referring to FIG. 3, a steering actuator 56 is configured to rotate the steering column 46 together with lower unit 38 with respect to the steering housing 28 and engine 22. The type and configuration of the steering actuator 56 can vary. In the example shown in FIG. 3, the steering actuator 56 is a hydraulically-actuated mechanism controlled by a supply of hydraulic fluid from a conventional hydraulic pump (not shown). The steering actuator 56 has an elongated cylinder 60 to which the pump provides a pressurized supply of hydraulic fluid. In this example, the elongated cylinder 60 is formed in the main body 29 of the steering housing 28 and particularly through opposing sidewalls 19 on opposite sides of the steering housing 28, as shown. The steering actuator 56 further has an elongated piston 62 that is located in the cylinder 60. The piston 62 is movable (i.e., slide-able) back and forth in the cylinder 60 under pressure from the hydraulic fluid provided by the pump.

The steering actuator 56 is operably coupled to the steering column 46 by a rack and pinion, which in this example includes sets of teeth 70, 72 on the piston 62 and the center column 48 of the steering actuator 56, respectively. The sets of teeth 70, 72 are meshed together so that back-and-forth movement of the piston 62 within the cylinder 60 causes the teeth 70 on the piston 62 to move teeth 72 on the center column 48, which in turn causes corresponding back-and-forth rotational movement of the center column 48 about the steering axis 44. Thus, operation of the steering actuator 56 causes the rack and pinion to rotate the steering column 46 together with the lower unit 38 about the steering axis 44 with respect to the steering housing 28 and engine 22. The supply of pressurized hydraulic fluid from the pump to the cylinder 60 can be controlled by a conventional valve arrangement and a conventional operator input device for controlling steering movement of the marine propulsion device 20, such as a steering wheel, joystick, automated positioning system, and/or the like, all as is conventional.

In another example, the steering actuator 56 is mounted to an outer surface of the main body 29 of the steering housing 28 by bolts, rather than being formed with the main body 29. Further, the steering actuator 56 is coupled to the steering column 46 by a yoke and trunnion instead of the rack and pinion. Further details of this embodiment are disclosed in Applicant's co-pending U.S. application Ser. No. 16/171,490, filed Oct. 26, 2018, which was incorporated by reference herein above.

During research and development, the present inventors realized that the spinning driveshaft 24 places a large torque load on the steerable lower unit 38, which torque load is required to be counteracted by the steering actuator 56 in order to hold the lower unit 38 (and thus the thrust-producing propellers 43) in a desired position to steer a marine vessel. In other words, the hydraulic pump must provide enough pressurized hydraulic fluid to the cylinder 60 to maintain the piston 62 in a desired position against the torque load from the driveshaft 24 that tends to rotate the lower unit 38 (and thus the steering column 46 and the piston 62 connected thereto) away from this position. The present inventors realized that producing a moment on the lower unit 38 in a direction opposite the driveshaft's rotational direction DR could reduce the resultant load on the steering system, which would increase the life of the system and/or allow for less robust (and therefore less expensive and/or lighter) parts to be used. The present inventors determined that by cambering the skeg 116 or the gearcase housing 110 of the lower unit 38, the torque induced by the driveshaft 24 could be countered, and overall load on the steering system reduced.

Figure 5:
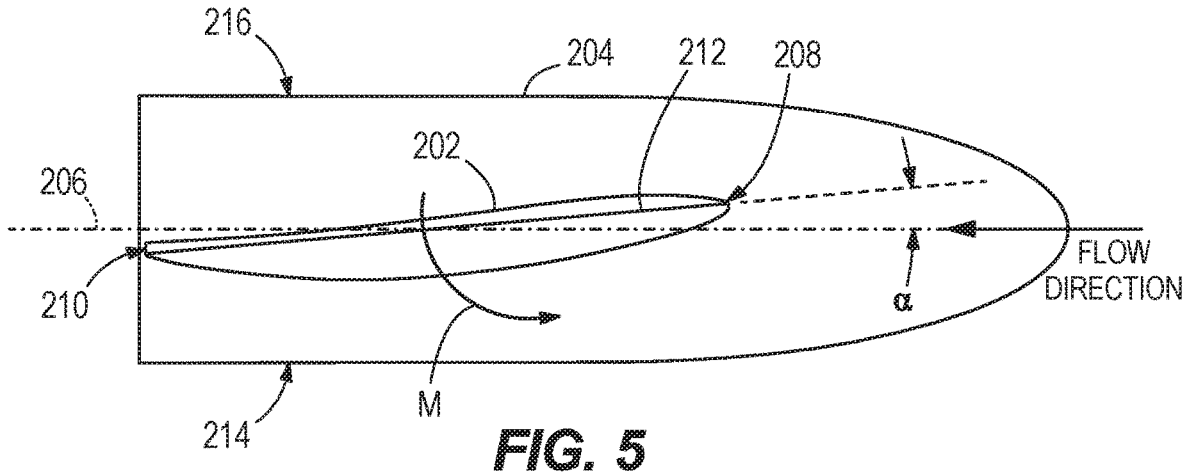
FIG. 5 illustrates a schematic of a cambered skeg on a gearcase housing, the skeg having a negative angle of attack.
Figure 6:
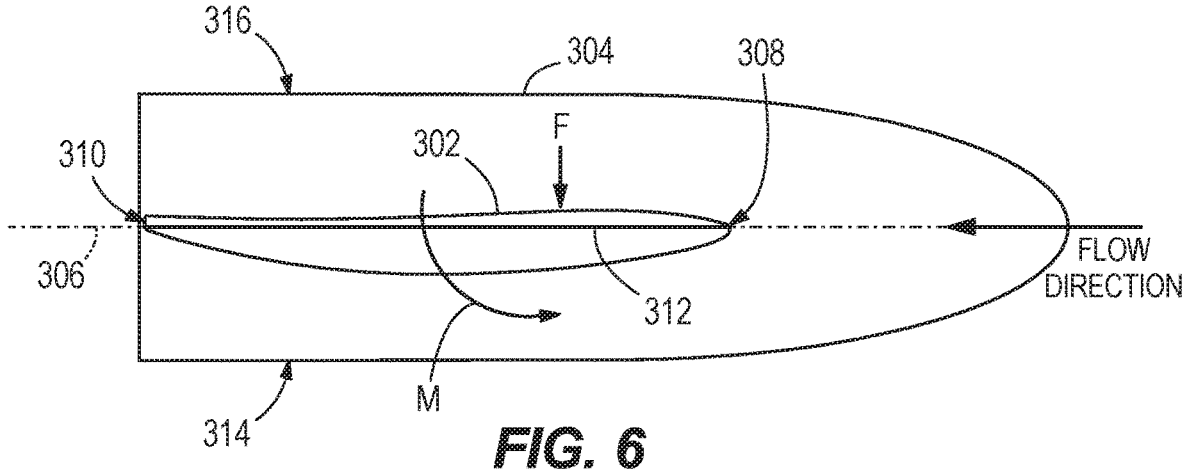
FIG. 6 illustrates a schematic of a cambered skeg on a gearcase housing, the skeg having zero angle of attack.
Figure 7:
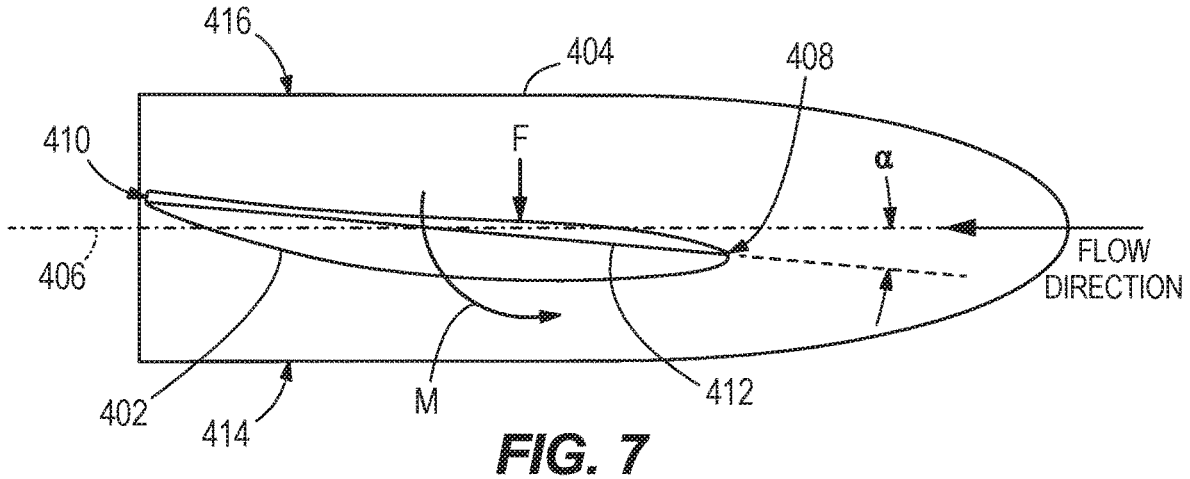
FIG. 7 illustrates a schematic of a cambered skeg on a gearcase housing, the skeg having a positive angle of attack.

Before the details of the present invention are described, FIGS. 5-7 are referred to in order to illustrate how both the angle of attack a and the camber of a skeg have an effect on forces created on a gearcase housing as a lower unit moves through water.

FIG. 5 shows a bottom view of a skeg 202 on a gearcase housing 204. A direction of water flow is shown by the arrow, and continues along dashed line 206, which in this example is coincident with the longitudinal centerline of the gearcase housing 204. The skeg 202 has a leading edge 208 and a trailing edge 210. An angle of attack a of the skeg 202 is defined by the angle between a chord line 212 connecting the leading edge 208 and trailing edge 210 with respect to the flow direction of the water 206. Due to its negative angle of attack a, the skeg 202 deflects the oncoming flow of water 206 to the port side 214 of the gearcase housing 204, causing an equal and opposite force to act on the skeg 202. However, note that the skeg 202 is also cambered. The camber of the skeg 202 also deflects the oncoming flow of water 206, but toward the starboard side 216 of the gearcase housing 204, causing an equal and opposite force to act on the skeg 202. In this example, the forces due to the negative angle of attack and camber cancel one another out, and no resultant side force acts on the skeg 202. However, the camber does cause a moment M to act on the skeg 202. Note that the location and dimension of moment M are for illustrative purposes only and are not to-scale. Note also that if the skeg 202 were cambered in the opposite direction of that shown, the moment would have an opposite direction, and a side force would also be created toward the starboard side 216 of the gearcase housing 204, assuming the angle of attack remained the same (although it would be considered positive due to the opposite camber).

FIG. 6 shows a bottom view of a skeg 302 on a gearcase housing 304. The direction of the flow of water is again shown by an arrow and dashed line 306, and again coincides with the longitudinal centerline of the gearcase housing 304. The angle of attack in FIG. 6 is zero degrees, as the chord line 312 connecting the leading and trailing edges 308, 310 of the skeg 302 is aligned with the water's flow direction 306. Here, a moment M is again created due to the skeg's camber. Additionally, the camber of the skeg 202 causes water to be deflected to the starboard side 316 of the gearcase housing 304, and an equal and opposite resultant side force F acts on the skeg 302 toward the port side 314. This force F will tend to rotate the gearcase housing 304 about a stationary axis of rotation, such as the steering axis 44 in the example of FIGS. 1-4. Note that the force F is shown for illustrative purposes only, and its location and dimension are not to-scale. Note also that if the skeg 302 were not cambered (i.e., symmetric), and oriented at an angle of attack of zero degrees, no side force or moment would be created. If the camber of the skeg were opposite that shown, and the angle of attack remained zero, the side force would instead be directed toward the starboard side 316 of the gearcase housing 304.

FIG. 7 shows a bottom view of a skeg 402 on a gearcase housing 404. The direction of the flow of water is again shown by an arrow and dashed line 406, and again coincides with the longitudinal centerline of the gearcase housing 404. The angle of attack a here is a positive angle of attack, defined between the chord line 412 connecting the leading and trailing edges 408, 410 of the skeg 402 and the water's flow direction 406. In this example, the angle of attack a causes the flow of water 406 to be diverted to the starboard side 416 of the gearcase housing 404, and an equal and opposite force therefore acts on the skeg 402. The camber, which is the same as in the examples of FIGS. 5 and 6, also causes water to be diverted to the starboard side 416 of the gearcase housing 404, and an equal and opposite resultant force thus acts on the skeg 402. The resultant force F on the skeg 402 is the sum of the reactionary forces due to the angle of attack and camber, and acts toward the port side 414 of the gearcase housing 404. This additive force F will tend to rotate the gearcase housing 404 about an axis of rotation, such as the steering axis 44. A moment M is also created in the example of FIG. 7, as in the previous examples. Note that the moment M in each of the examples of FIGS. 5-7 is more or less constant for a large range of angles of attack and increases slightly at very high angles of attack not at issue for a marine propulsion device. Note that, all else being equal except the angle of attack, the force will be higher in the example shown in FIG. 7 than that shown in FIG. 6, but the forces are not shown to scale. Also note that if the skeg 402 were cambered in the opposite direction, the force on the skeg 402 due to camber would be in the opposite direction and thus subtracted from the force due to the angle of attack.

Returning to FIGS. 1-4, a marine propulsion device 20 with decreased torque bias about the steering axis 44 is disclosed. The marine propulsion device 20 comprises an engine 22, a driveshaft 24 configured to be powered by the engine 22 and thereby to rotate in a direction of rotation DR, a propulsor shaft (such as propeller shafts 40) coupled in torque-transmitting relationship with the driveshaft 24 (either directly or by way of an extension member), and a propulsor (such as propellers 43) coupled to the propulsor shaft (e.g., propeller shafts 40) and rotatable to produce a thrust. The marine propulsion device 20 shown herein is an outboard motor, but the present invention is equally applicable to a stern drive or a pod drive. In still other examples, the marine propulsion device is a "tractor" drive, in which the propulsor (propeller) is located fore of the gearcase housing. In other examples, the propulsor is an impeller, such as used for a jet drive. A housing (such as the gearcase housing 110) supports the propulsor shaft therein, the housing having a skeg 116 projecting from a bottom surface 118 thereof. In other examples, the housing may not hold any gears, and thus may not be considered a "gearcase" housing.

In the present example, the driveshaft 24 is oriented perpendicular to the propulsor shaft (e.g., propeller shafts 40). In other examples, the driveshaft 24 may be oriented non-perpendicular (but also non-parallel) with respect to the propulsor shaft, such as if the shafts are oriented at 80 degrees with respect to one another. The housing is steerable about a steering axis 44 to affect a direction of thrust produced by the propulsor. In the present example, the housing (e.g., gearcase housing 110) is steerable about the steering axis 44 independently of the engine 22 to affect a direction of the thrust produced by the propulsor (e.g., propellers 43). However, the concepts disclosed herein could be used on a single-propeller marine drive. The propeller on a single-propeller marine drive creates a net side force, especially when the propeller is lifted on faster boats. The same concepts disclosed herein therefore could be implemented on such a single-propeller drive in order to minimize the net steering torque on the traditional steering system during straight-ahead operation. Although in the present example the lower unit 38 is steerable about the steering axis 44 to change a direction of thrust produced by the marine propulsion device 20, the single-propeller lower unit need not be steerable.

Figure 10:
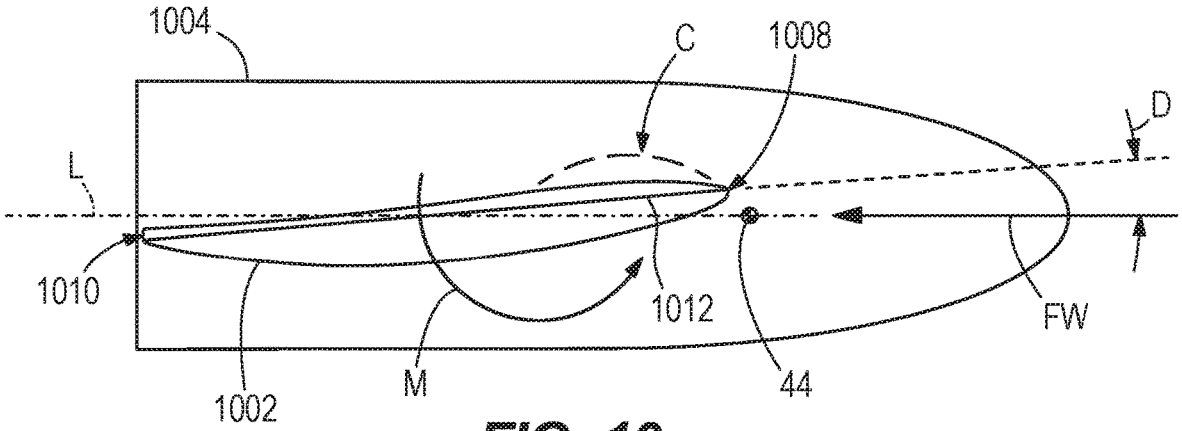
FIG. 10 illustrates a schematic of a cambered skeg on a gearcase housing, the skeg having a chord line oriented at a non-zero angle with respect to the longitudinal axis of the gearcase housing, and the gearcase housing having an unbiased steered position.
Figure 11:
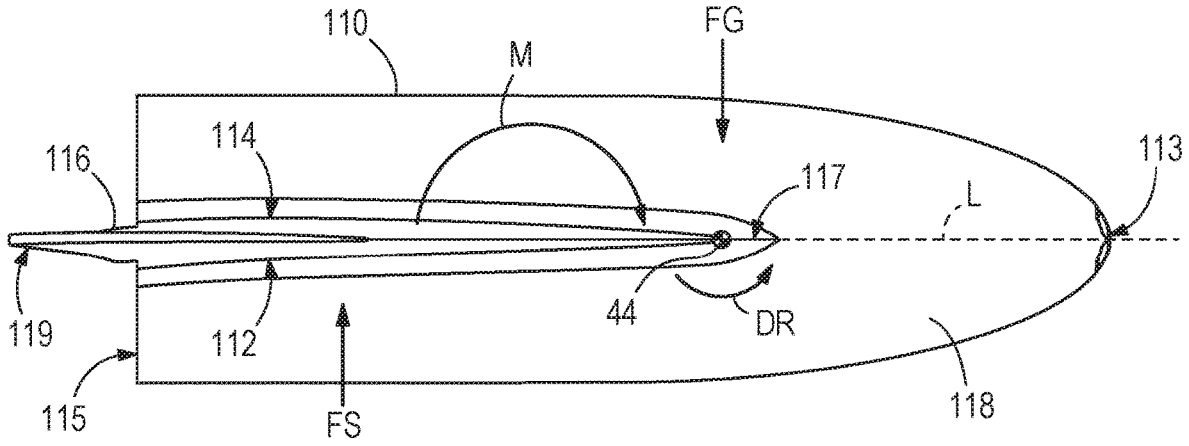
FIG. 11 illustrates a bottom view of the gearcase housing of FIGS. 1 and 4.
Figure 12:
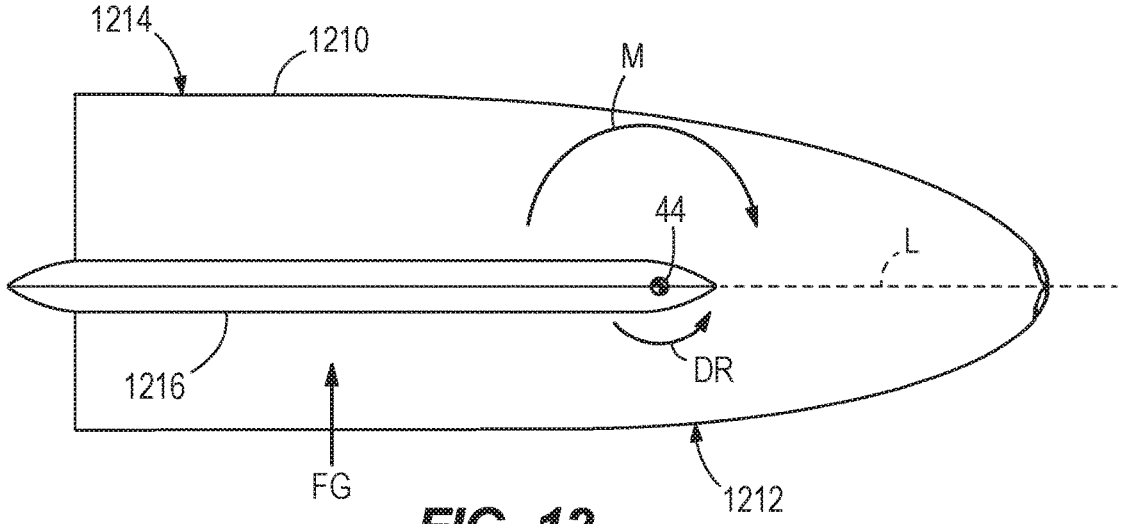
FIG. 12 illustrates another example of a gearcase according to the present disclosure, the gearcase housing being cambered.

FIGS. 8-12 illustrate various embodiments of gearcase housings according to the present disclosure, in which one of the skeg and the gearcase housing is cambered such that a moment M acting in a direction opposite the driveshaft's direction of rotation DR is induced on the one of the skeg and the housing as the housing moves through water. Each of the embodiments shows the respective gearcase housing from below. In the examples of FIGS. 8-11, the gearcases each have a cambered skeg. As shown by the arrows M, the camber of each skeg causes water flowing past the skeg to produce a moment on the skeg (and thus on the gearcase housing). Specifically, the camber of each skeg is oriented such that the rotational direction of each moment is opposite the driveshaft's direction of rotation. In FIG. 12, the entire gearcase is cambered to achieve the same effect. Further details of each embodiment are provided below.

Figure 8:
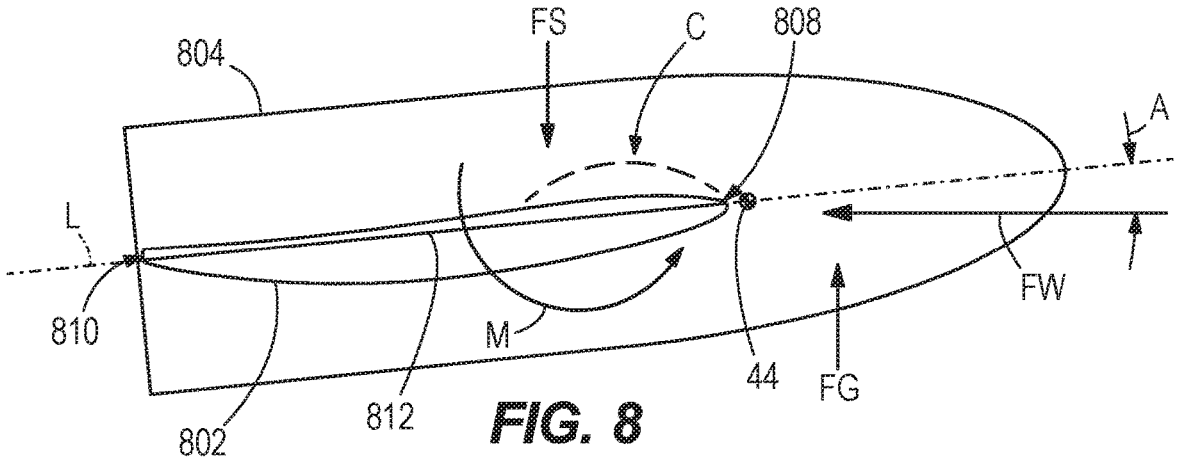
FIG. 8 illustrates a schematic of a cambered skeg on a gearcase housing, the skeg having a chord line aligned with the longitudinal axis of the gearcase housing, and the gearcase housing having a biased steered position.
Figure 9:
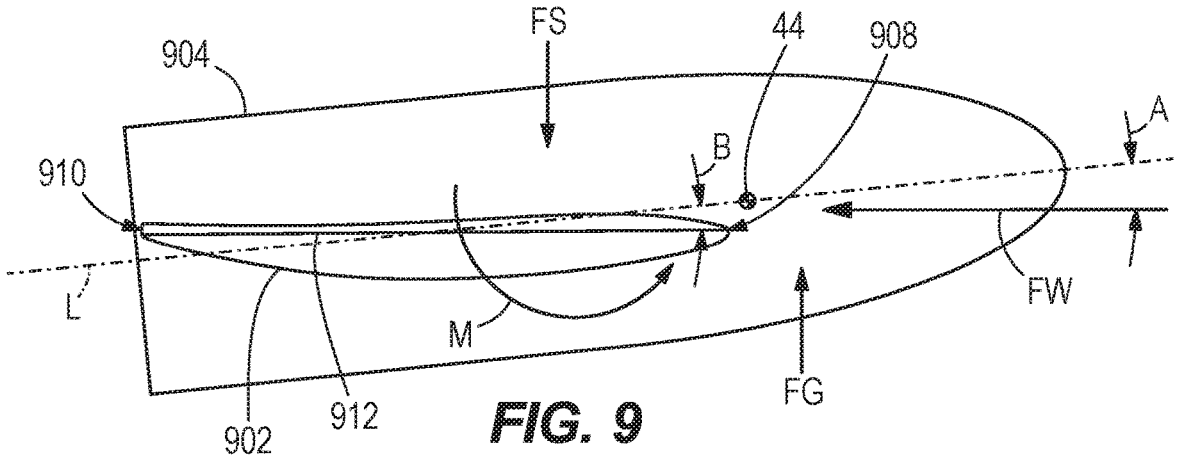
FIG. 9 illustrates a schematic of a cambered skeg on a gearcase housing, the skeg having a chord line oriented at a non-zero angle with respect to the longitudinal axis of the gearcase housing, and the gearcase housing having a biased steered position.

FIGS. 8 and 9 illustrate examples in which a steered position of the lower unit (and thus gearcase housing) about the steering axis 44 is biased by a predetermined angle A, opposite the driveshaft's direction of rotation. (In these examples, the driveshaft's direction of rotation is presumed to be clockwise when viewed from below the gearcase.) As shown in FIG. 8, if the skeg 802 is cambered and oriented straight on the gearcase housing 804 (i.e., the chord line 812 connecting the leading edge 808 and the trailing edge 810 of the skeg 802 is aligned with the longitudinal center axis L of the gearcase housing 804), a moment M and a side force FS are created. This is because, at zero angle of attack, a cambered airfoil has both a positive "lift" coefficient and a positive moment coefficient. However, because there is a side force FS created by the cambered skeg 802, the gearcase housing 804 must be steered to compensate if the marine propulsion device is to propel the vessel straight forward. Once the gearcase housing 804 is steered enough to compensate for the side force FS (here, to the angle A), the angled position of the gearcase housing 804 with respect to the flow direction of water FW causes a side force FG to act on the gearcase housing 804. Because the center of pressure of the skeg 802 is aft of the center of pressure of the gearcase housing 804, another moment is created, which adds to the constant moment M created by the cambered skeg 802. The additive moments act in a direction tending to oppose the torque from the driveshaft 24.

However, because the configuration of FIG. 8 requires that the skeg 802 operate at a non-zero angle of attack due to the biased steered position, early cavitation (as shown by the arrow C) occurs on the pressure side of the skeg 802, which may lead to damage as the cavitation collapses in the high-pressure region further back. Thus, in the configuration of FIG. 9, the chord line 912 connecting the leading edge 908 and the trailing edge 910 of the skeg 902 is oriented at a non-zero angle B with respect to the longitudinal center axis L of the gearcase housing 904. The non-zero angle B is in the driveshaft's direction of rotation, which here, is clockwise (and opposite the counter-clockwise direction of the moment M). In one example, the non-zero angle B of the chord line 812 with respect to the longitudinal center axis L has the same magnitude as the predetermined angle A by which the steered position of the lower unit is biased. In other words, the skeg 902 is oriented with its leading edge 908 aligned with the flow of water FW. When the skeg 902 is oriented at such a "shock-free" angle, cavitation on the skeg 902 is less likely. However, if the camber of the skeg 902 is the same as that in FIG. 8, such an orientation will produce even more side force FS, and so would require even more counter-balancing force FG on the gearcase housing 904. Thus, the camber of the skeg 902 can be less than that of the skeg 802 while still providing the same net steering moment.

In order to determine the angle A at which the steered position of the gearcase housing 804 or 904 should be biased, a marine propulsion device with a skeg having the desired camber can be operated in the water. An operator at the steering wheel can rotate the steering wheel until the vessel moves straight forward. A steering angle sensor (such as a potentiometer, a Hall effect sensor, or other known device) located at the steering wheel or steering actuator can determine the angle at which the gearcase housing 804 or 904 is rotated in order to compensate for the side force FS created by the cambered skeg 802 or 902. Alternatively, the gearcase housing 804 or 904 with the cambered skeg 802 or 902 can be modeled using a computational fluid dynamics program in order to determine the angle A at which the modeled side forces FS and FG are equal or near equal in magnitude. Note that the angle A will for most systems be less than 10 degrees.

Once the angle A has been determined, this angle A can be programmed as a bias to be used when a controller (such as, but not limited to, a helm control unit or an engine control unit) determines the angle at which to steer the gearcase housing in response to steering input. By way of non-limiting example, assuming the bias angle is A, if a steering wheel position of 10 degrees from center would normally map to a steered position of the gearcase housing about the steering axis of 3 degrees, the steered position of the gearcase housing would instead map to 3 degrees+A (noting that both the original mapped value and A could be negative depending on the convention used). Similarly, when the steering wheel is in the straight-ahead position, the bias would cause the gearcase housing to be oriented at the angle A with respect to the vessel's direction of travel (and thus the flow direction of water). Note that the same bias would be applied to determine a steered position of the gearcase housing in response to any joystick input or auto-steering input. To apply the bias, the steering angle map could be altered, or the empirically- or CFD-determined angle A could be added to the steering angle determined from an existing steering angle map.

In another example, instead of applying the steered position bias by way of software, a hardware solution could be implemented. For example, when the steering system like that of FIGS. 1-4 is assembled, the lower unit 38 can be attached such that the longitudinal axis L of the gearcase housing 110 is normally rotated to the angle A with respect to a longitudinal direction of the steering housing 28. Any steering commands carried out by the steering actuator 56 would thus automatically be biased by the angle A.

Turning now to the example of FIG. 10, here, the chord line 1012 connecting the leading edge 1008 and the trailing edge 1010 of the skeg 1002 is oriented at a non-zero angle D with respect to the longitudinal center axis L of the gearcase housing 1004. Here, the non-zero angle D is in a direction opposite the driveshaft's direction of rotation, i.e., is counterclockwise when viewed from below, the same as the direction of the moment M due to the camber of the skeg 1002. This configuration of the skeg 1002 on the gearcase housing 1004 allows the gearcase's longitudinal axis L to remain aligned with the flow direction of water FW. The moment M due to the camber of the skeg 1002 is present, but no side force is created, because for this particular camber at this particular angle of attack, the side force ("lift" for an airfoil) is zero. However, as with the example of FIG. 8, the skeg 1002 is oriented at a non-zero angle of attack with respect to the flow direction of water FW, and therefore early cavitation (as shown at the arrow C) occurs on the pressure side of the skeg 1002, which may lead to damage as the cavitation collapses in the high pressure region further back.

FIG. 11 illustrates the gearcase housing 110 of the example of FIGS. 1 and 4, shown looking up from below. The skeg 116 is cambered such that the starboard side 114 thereof is convex and the port side 112 thereof is concave. Moreover, the aft end of the skeg 116 (near the trailing edge 119) has greater camber than the fore end of the skeg 116 (near the leading edge 117). In this example, the chord line connecting the leading edge 117 and the trailing edge 119 of the skeg 116 is oriented at a non-zero angle with respect to the longitudinal center axis L of the gearcase housing 110, although the angle is slight enough that it cannot be perceived in this view. The angle of the chord line is in the driveshaft's direction of rotation DR, in order to orient the skeg 116 at the shock-free angle as the gearcase housing 110 moves through water at a biased steering angle. Effectively, the arrangement of FIG. 11 is the mirror image of that of FIG. 9 (other than the exact shape of the skegs). Thus, it can be seen from comparing FIG. 9 that a moment M and a side force FS will be induced on the skeg 116 due to the camber and angle of attack of the skeg 116. A counterforce FG will be induced on the gearcase housing 110 due to an applied steering angle bias opposite the drive shaft's direction of rotation DR and resulting angle of attack of the gearcase housing 110 with respect to the flow direction of water.

Because the camber of the skeg 116 is located toward the trailing edge 119 thereof, this moves the location of the center of pressure of the skeg 116 (where the side force FS is presumed to act) to the rear of the gearcase housing 110. The skeg 116 itself is also located at the aft end 115 of the gearcase housing 110 and in fact even overhangs the aft end 115. Such placement of the skeg 116 and camber thereof allows the side force FS on the skeg 116 and the side force FG on the gearcase housing 110 to be separated from one another as much as possible, which locates these forces far from the steering axis 44 and thus maximizes the moment tending to counteract the torque from the driveshaft 24.

FIG. 12 illustrates an example in which the gearcase housing 1210 is cambered such that a moment M acting in a direction opposite the driveshaft's direction of rotation DR is induced on the gearcase housing 1210 as the lower unit moves through water. In the example shown, the skeg 1216 is symmetric and thus water flowing thereby induces no moment, but a non-symmetric skeg could alternatively be provided. Cambering of the gearcase housing 1210 could be accomplished by forming the gearcase housing 1210 with one lateral half having a larger radial dimension than the other or by adding a separate component onto a torpedo-shaped gearcase housing that creates a cambered shape. Here, a dimension between the longitudinal centerline L of the gearcase housing 1210 and the starboard side 1214 thereof is greater than a dimension between the longitudinal centerline L of the gearcase housing 1210 and the port side 1212 thereof. A moment M is created by the camber, as well as a side force FG. To counteract the side force FG, a steered position of the gearcase housing 1210 about the steering axis 44 may be biased by a predetermined angle, opposite the driveshaft's direction of rotation DR. This angle can be determined in the same manner as that described above with respect to FIGS. 8 and 9.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A lower unit for a marine propulsion device, the lower unit comprising:

a gearcase housing defined along a longitudinal center axis between a fore end and an aft end;

a propulsor shaft extending through the gearcase housing along the longitudinal center axis;

a driveshaft extending non-parallel to the propulsor shaft, the driveshaft being configured to rotate in a direction of rotation when powered, and the driveshaft being coupled in torque-transmitting relationship with the propulsor shaft; and a skeg projecting from a bottom surface of the gearcase housing proximate at least the aft end thereof;

wherein one of the skeg and the gearcase housing is cambered such that a moment acting in a direction opposite the driveshaft's direction of rotation is induced on the one of the skeg and the gearcase housing as the lower unit moves through water.

2. The lower unit of claim 1, wherein the lower unit is steerable about a steering axis to change a direction of thrust produced by the marine propulsion device.

3. The lower unit of claim 2, wherein a steered position of the lower unit about the steering axis is biased by a predetermined angle, opposite the driveshaft's direction of rotation.

4. The lower unit of claim 3, wherein a chord line connecting a leading edge and a trailing edge of the skeg is aligned with the longitudinal center axis of the gearcase housing.

5. The lower unit of claim 3, wherein a chord line connecting a leading edge and a trailing edge of the skeg is oriented at a non-zero angle with respect to the longitudinal center axis of the gearcase housing, in the driveshaft's direction of rotation.

6. The lower unit of claim 5, wherein the non-zero angle of the chord line with respect to the longitudinal center axis of the gearcase housing has the same magnitude as the predetermined angle by which the steered position of the lower unit is biased.

7. The lower unit of claim 2, wherein the lower unit is steerable about the steering axis independently of an engine of the marine propulsion device that is configured to power the driveshaft.

8. The lower unit of claim 1, wherein a center of pressure of the skeg is aft of a center of pressure of the gearcase housing.

9. The lower unit of claim 8, wherein the skeg is cambered, and an aft end of the skeg has greater camber than a fore end of the skeg.

10. The lower unit of claim 1, wherein a chord line connecting a leading edge and a trailing edge of the skeg is oriented at a non-zero angle with respect to the longitudinal center axis of the gearcase housing, opposite the driveshaft's direction of rotation.

11. A marine propulsion device comprising:

a driveshaft configured to be powered to rotate in a direction of rotation;

a propulsor shaft coupled in torque-transmitting relationship with the driveshaft;

a propulsor coupled to the propulsor shaft and rotatable to produce a thrust; and a housing supporting the propulsor shaft therein, the housing having a skeg projecting from a bottom surface thereof;

wherein one of the skeg and the housing is cambered such that a moment acting in a direction opposite the driveshaft's direction of rotation is induced on the one of the skeg and the housing as the housing moves through water.

12. The marine propulsion device of claim 11, wherein the housing is steerable about a steering axis to affect a direction of the thrust produced by the propulsor.

13. The marine propulsion device of claim 12, further comprising an engine configured to power the driveshaft, wherein the housing is steerable about the steering axis independently of the engine.

14. The marine propulsion device of claim 12, wherein a steered position of the housing about the steering axis is biased by a predetermined angle, opposite the driveshaft's direction of rotation.

15. The marine propulsion device of claim 14, wherein a chord line connecting a leading edge and a trailing edge of the skeg is aligned with a longitudinal center axis of the housing.

16. The marine propulsion device of claim 14, wherein a chord line connecting a leading edge and a trailing edge of the skeg is oriented at a non-zero angle with respect to a longitudinal center axis of the housing, in the driveshaft's direction of rotation.

17. The marine propulsion device of claim 16, wherein the non-zero angle of the chord line with respect to the longitudinal center axis of the housing has the same magnitude as the predetermined angle by which the steered position of the housing is biased.

18. The marine propulsion device of claim 11, wherein a chord line connecting a leading edge and a trailing edge of the skeg is oriented at a non-zero angle with respect to a longitudinal center axis of the housing, opposite the driveshaft's direction of rotation.

19. The marine propulsion device of claim 11, wherein the skeg is cambered, and an aft end of the skeg has greater camber than a fore end of the skeg.

20. The marine propulsion device of claim 11, wherein the driveshaft is oriented non-parallel to the propulsor shaft.

* * * * *